United States Patent [19]

Pauls

[11] Patent Number: 4,631,970

[45] Date of Patent: Dec. 30, 1986

[54] PUMPING UNIT

[75] Inventor: Dennis A. Pauls, Garden City, Kans.

[73] Assignee: Jerden Industries, Inc., Garden City, Kans.

[21] Appl. No.: 487,522

[22] Filed: Apr. 22, 1983

[51] Int. Cl.[4] ..... F04B 47/02

[52] U.S. Cl. ..... 74/44; 74/41; 74/108; 74/587

[58] Field of Search ..... 74/41, 44, 89.2, 89.21, 74/89.22, 108, 587

[56] References Cited

U.S. PATENT DOCUMENTS

| | | | |
|---|---|---|---|
| 557,496 | 3/1896 | Duryea | 74/587 |
| 828,624 | 8/1906 | McIntire | 74/44 |
| 990,743 | 4/1911 | Jennings . | |
| 1,269,343 | 6/1918 | Wacker . | |
| 1,277,382 | 9/1918 | Chapman . | |
| 1,495,539 | 5/1924 | Tompkins | 74/587 |
| 1,655,062 | 1/1928 | Kammerer et al. . | |
| 1,707,137 | 3/1929 | Pickett | 74/108 |
| 1,944,284 | 1/1934 | Valentine et al. | 474/91 |
| 1,982,634 | 12/1934 | Caldwell | 74/44 |
| 2,241,153 | 5/1941 | Murray | 74/44 |
| 2,914,932 | 12/1959 | Emrick | 74/587 |
| 3,027,771 | 4/1962 | Winfrey | 74/37 |
| 3,159,107 | 12/1964 | Hallmark | 74/41 |
| 3,310,988 | 3/1967 | Gault | 74/41 |
| 4,121,471 | 10/1978 | Chancellor | 74/41 |
| 4,391,155 | 7/1983 | Bender | 74/89.2 |

FOREIGN PATENT DOCUMENTS

| | | | |
|---|---|---|---|
| 500130 | 2/1939 | United Kingdom | 474/91 |

OTHER PUBLICATIONS

Greeno Industries advertisement, Oiltizer Magazine, vol. 5, No. 20, Jul. 25, 1982.

*Primary Examiner*—Lawrence Staab

*Attorney, Agent, or Firm*—Sheridan, Ross & McIntosh

[57] ABSTRACT

A pumping unit for pumping fluids from a location beneath the surface of a field. The rotary motion of a crankarm is changed to a reciprocating motion of a pair of flexible members by pitman arms pivotally secured at one end to the crankarm and at the other end to the flexible members which extend from such connection over a plurality of rollers and then vertically downward toward the well head. The flexible members are connected at their other ends to means connected to the polished rod. Portions of the flexible members and the polished rod lie in the same vertical plane so that true vertical reciprocating movement is imparted to the polished rod. The flexible members comprise non-metallic straps having a substantial width to provide stability of movement.

4 Claims, 4 Drawing Figures

PUMPING UNIT

FIELD OF INVENTION

This invention relates to a pumping unit suitable for use in a field for operating a pump to remove fluids, such as oil, from beneath the surface of the field and is particularly useful in fields having center pivot sprinkler irrigation systems because of the low profile of the pumping unit.

BACKGROUND OF THE INVENTION

For many years, oil from beneath the surface of a field has been pumped by means of a pumping unit which reciprocates a polished rod connected to a drill string to operate a submerged pump. Various types of pumping units are available such as those in Jennings (U.S. Pat. No. 990,743), Wacker (U.S. Pat. No. 1,269,343), Chapman et al. (U.S. Pat. No. 1,277,382) and Kammerer et al. (U.S. Pat. No. 1,655,062). In these patents various means are provided to ensure the true vertical movement of the polished rod. However, in all these devices, the movement of the polished rod is derived from cables or ropes. While these patents do provide means for pumping oil from beneath a surface, the operational characteristics were such that some improvements were desired.

BRIEF SUMMARY OF THE INVENTION

The pumping unit of this invention provides means for assuring that a true vertical reciprocation of the polished rod is accomplished. In the preferred embodiment of the invention, this is accomplished by locating a roller so that the centerline of a strap moving over the roller and connected to the polished rod lies in the same vertical plan as the centerline of the polished rod. The strap has a substantial width so that its movement over the roller is stabilized so that a true vertical movement is provided for the polished rod. The strap is connected at its other end to a lever which is pivotally connected to a member which is adapted to be moved in a circular path. This association changes a rotary motion into a reciprocating motion so that the polished rod is reciprocated in a vertical path. The preferred embodiment also includes a continuous oil bath lubrication system for all of the moving parts. The strap is preferably formed from a polyster woven PVC covered material having a width of about three to twenty-four inches. The cooperation between the various parts of the pumping unit of the preferred embodiment is such that the pumping unit has a low profile permitting it to be readily utilized in a field having a center pivot sprinkler irrigation system.

Other features and advantages of the invention will be apparent from the following more particular description of preferred embodiments as illustrated in the accompanying drawings in which like reference characters refer to the same parts throughout the various views. The drawings are not necessarily to scale, emphasis instead being placed upon illustrating the principles of the invention.

DETAILED DESCRIPTION OF THE INVENTION

Figure 1:
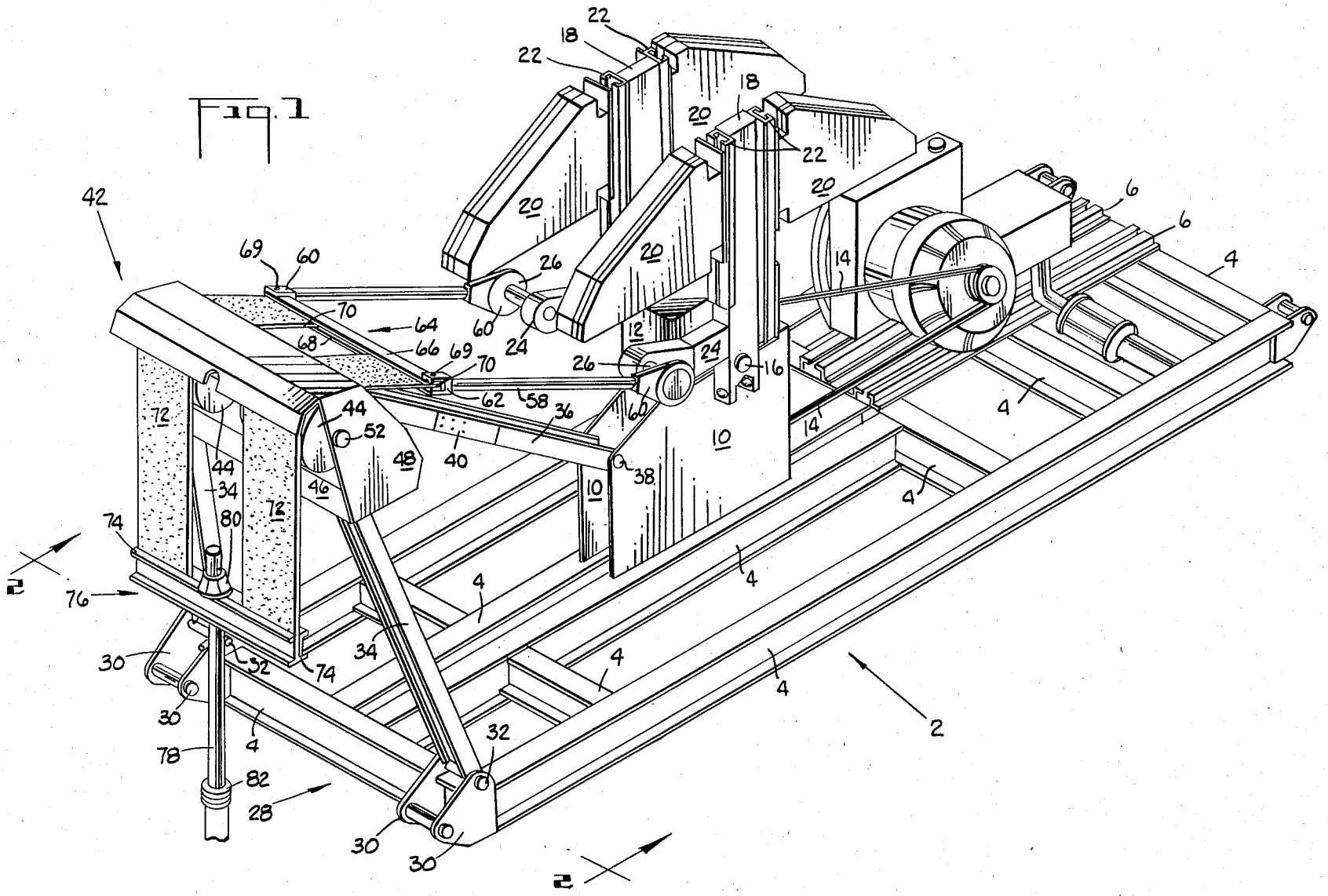
FIG. 1 is a pictorial view of a pumping unit of this invention.
Figure 2:
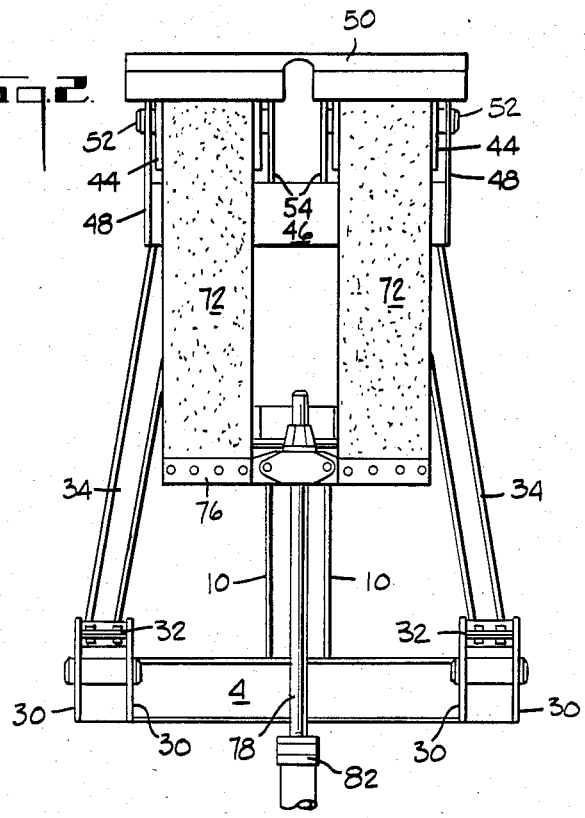
FIG. 2 is a cross-section taken on the lines 2—2 of FIG. 1.

As illustrated in FIG. 1, the pumping unit comprises a base 2 formed from a plurality of frame members 4 suitably joined together to provide a support which may be positioned on the ground and be strong enough to withstand the forces generated by the pumping unit during operation. A pair of slide rails 6 are mounted on the upper side of the base 2. A motor 8 is mounted for movement over the rails 6 and is provided with means (not shown) for locking the motor 8 at a desired location on the rails 6.

A pair of support plates 10 are suitably secured to the upper surface of central frame members 4 such as by welding. A gear reducing unit 12 is supported on the plates 10 and is operatively connected to the motor 8 by driving means 14. The gear reducing unit 12 functions to rotate the shaft 16 at a desired speed. The shaft 16 has an axial length greater than the distance between the plates 10. Crankarms 18 are secured to the shaft 16 at a location between the end of the shaft 16 and the nearest plate member for rotation therewith. A plurality of counterweights 20 are adjustably mounted on the crankarms 18 by means such as by the tongue and groove arrangement 22. Crankarm doglegs 24 extend from the crankarms 18 and are secured to the crankarms 18 by suitable means, such as welding, for rotation therewith. A wrist pin 26 is secured in each crankarm dogleg 24. Suitable clearance is provided between the surface of each plate 10 and the crankarms 18, counterweights 20 and crankarm doglegs 24 so that these units may rotate with the shaft 16.

At the front 28 of the base 2, there are plates 30 secured to the frame members 4. A pin 32 extends between adjacent plates 30 as is secured thereto. A front post leg 34 is pivotally mounted on each of the pins 32. A rear post leg 36 is pivotally mounted on a pin 38 extending between and secured to the plates 10. Means 40 are provided on the rear post leg 36 for a purpose described below. The front post legs 34 and the rear post leg 36 support a housing 42 in which a plurality of rollers 44 are mounted. The housing 42 comprises a base 46, side plates 48 and cover 50, all of which are joined together by suitable means, such as by welding. Each roller 44 is rotably mounted on a shaft 52 which extends between the side plates 48 and support plates 54 secured to the housing 42 and each shaft is supported by these plates.

A pitman arm 58 is pivotally connected at one end to each wrist pin 26 by suitable means (described below) in the housing 60. At the other end of each pitman arm 58, there is secured a U-shaped member 62. A beam 64 extends between the pitman arms 58 and is positioned in the U-shaped members 62. The beam 64 has an upper leg 66 and a lower leg 68. The ends 70 of bridle straps 72 are positioned between the upper leg 66 and the lower leg 68 and secured thereto. The ends of the legs 66 and 68 are secured to the U-shaped members 62 by pin connection 69.

Each bridle strap 72 extends from the beam 64 and passes over and is in contact with the upper surface of each roller 44 and then extends vertically downward. The other end 74 of each bridle member 72 is secured in a bridle block 76 by suitable means, such as bolts. A central opening (not shown) is provided in a bridle block 76 and the end of the polished rod 78 extends through the opening and is secured to the bridle block 76 by suitable means 80. The polished rod 78 reciprocates up and down in the well head 82. The base 2 is positioned so that the centerline of each bridle strap 72 and the centerline of the polished rod 78 all lie in the same vertical plane.

Figure 3:
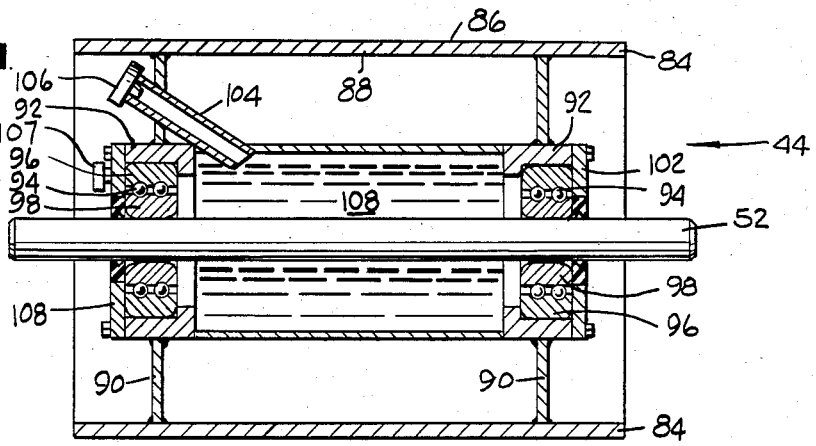
FIG. 3 is a cross-sectional view showing the lubricating system for the roller bearings.

In FIG. 3, there is illustrated the lubrication system for the rollers 44. Each roller 44 comprises a cylindrical body 84 having an external surface 86 which, in normal operation, is contacted by the strap 72. Secured to the internal surface 88 of the cylindrical body 84 in spaced apart relationship are a pair of support plates 90. A housing 92 for a bearing 94 is mounted in each support plate 90. The outer race 96 of each bearing 94 is secured in the housing 92 and the inner race 98 is secured to the shaft 52. A hollow cylindrical tube 100 extends between the housings 92 and is secured thereto by fluid tight means. Sealing means 102 are mounted on the external surface of the housings 92 and are in sealing engagement with the shaft 52. A hollow cylindrical fill tube 104 in fluid communication with the interior of the tube 100 is supported in one of the plates. The fill tube 104 is provided with a plug 106. A sight gauge 107 is provided so that the quantity of oil 108 in the tube 100 can be observed. The rollers 44 rotate in response to the reciprocating motion of the straps 72.

Figure 4:
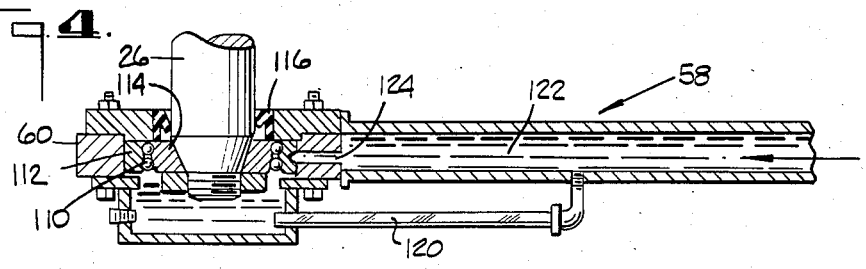
FIG. 4 is a cross-sectional view showing the lubricating system for the lever bearings.

In FIG. 4, there is illustrated the lubrication system for the pivotal connection between the pitman arm 58 and the wrist pin 26. A housing 60 for a bearing 110 is secured to each pitman arm 58 which, as illustrated in FIG. 4, is hollow. The outer race 112 of the bearing is secured to the housing 60 and the inner race 114 is secured to the wrist pin 26. Sealing means 116 are provided on one side of the housing and provide a fluid tight seal around the wrist pin 26. A bearing cap 118 is secured on the outer side of the housing 60. A clear hollow tube 120 is in fluid communication with the interior of the bearing cap 118 and the interior of the pitman arm 58. A supply of oil 122 is maintained in the pitman arm 58 and flows out of the pitman arm 58 into the bearing housing 60 through opening 124. The clear hollow tube 120 provides a visual indication of the presence of oil in the system and also provides a means for the circulation of the oil.

If desired, a tongue may be provided on the rear side of the base and axle on which wheels can be mounted may be provided adjacent the front of the base so that the pumping unit may be readily transported.

The operation of the pumping unit will be explained in relation to the illustration in FIG. 1. The base 2 is positioned adjacent the well head 82 so that the centerline of the straps 72 and the centerline of the polished rod 78 lie in the same vertical plane. When in position, the end of the polished rod 78 is inserted through the opening in the bridle block 76 and is secured thereto by the means 80. The straps 72 are of the same width and are spaced at equal distances from the polished rod 78. The straps 72 pass over the upper surfaces 86 of the rollers 44 and are secured to the equalizer beam 64. The bridle straps carry the well load, which includes the full weight of the rod string and fluid in the well, around the rollers 44 to the equalizer beam 64 which transfers the load to the pitman arms 58. A secondary purpose of the equalizer beam 64 is to allow the bridle straps 72 to adjust so that each will be carrying equal portions of the well load. The pitman arms 58 are pivotally connected to the wrist pins 26 of the crankarm doglegs 24. The crankarms 18 and crankarm doglegs 24 are connected to the shaft 16 of the gear reducer 12 which is driven by the motor 8 so that the shaft 16 may be rotated at a desired speed which is generally about one to twenty revolutions per minute.

The wrist pins 26 are located on the crankarm dogleg 24 so that the distance between the center of the shaft 16 and the outer surface of the wrist pin 26 is equal to about one-half of the length of the desired stroke. If desired, the wrist pin 26 may be slidably mounted on the crankarm dogleg 24 with means for securing it at desired locations so that the length of the stroke may be varied. The angular relationship between the location of the wrist pins 26 and the weight centers of the counterweights 20 must be such, that the weight centers are directly above the centerline of the shaft 16 in a vertical direction when the polished rod 78 is at the bottom of its stroke. Also, the weight centers of the counterweights 20 must be directly below the centerline of the shaft 16 in a vertical direction when the polished rod 78 is at the top of its stroke. As the crankarm doglegs 26 rotate, the pivotal connection between the pitman arms 58 and the wrist pins 26 changes the rotary motion of the wrist pins 26 to a reciprocating motion of the flexible straps 72. The action of the straps 72 after passing over the rollers 44 generates a perfectly vertical receiprocating up and down movement of the bridle block 76 and polished rod 78 without any substantial geometric losses. During operation of the pumping unit, the moving parts, comprising the rollers 44 and the pivotal connection of the pitman arms 58 and the wrist pins 26, are lubricated with the systems described above. The use of these systems provides a continuous oil bath lubrication that eliminates the daily greasing required on other pumping units.

At several times during the life of the pumping unit, it becomes necessary to work on the well itself. When this occurs, polished rod 78 is loosened so it may be removed from the bridle block 76 and the means 40 are loosened to allow the rear post leg 36 to be folded. The front post legs 34 will pivot around the pins 32 so that the housing 50, rollers 44, straps 72 and bridle block 76 move in a direction to the rear of the base to a location where they will not interfere with any equipment being used at the well head 82.

Pumping units made in accordance with this invention may be designed to cover a wide range of pumping requirements. The dimensions of the various elements may be varied as desired to have peak torque ratings between about 25,000 and 160,000 inch-pounds; structural capacity between about 6,700 and 20,000 pounds; strokes between about 24 and 74 inches; clearance heights between about 84 and 156 inches; reducer ratios between about 30 to 1; maximum ECB (Effective Counter Balance) between about 5,310 and 15,675 pounds; and crankarm swing radii between about 41 and 77 inches. The rollers 44 may have diameters from about 4 to 24 inches and have external surfaces with an axial length of from about 4 to 60 inches. The straps 72 are preferably formed from a polyster woven material covered with PVC such as the type marketed by B. F. Goodrich under the trade designation PVC Elevator Leg and Conveyor Belting. The straps 72 may vary in longitudinal length from about 52 to 128 inches and may vary in width from about 3 to 24 inches. The dimensions of the base frame will vary according to type of unit with the mid-use frame having a length of about 240 inches and a width of about 70 inches.

While the preferred embodiments of the invention have been illustrated and described herein, it may be otherwise embodied and practiced within the scope of the following claims.

What is claimed is:

1. A pumping unit for use at a well having a well head, comprising:

support means;

a pair of pitman arms, each of said pitman arms having a longitudinal axis and a first end portion and a second end portion;

means including crank arm means for causing movement said pitman arms, said means for causing movement connected to said support means and to said first end portion of each of said pitman arms;

a first strap having a width of at least inches and including a first end portion and a second end portion;

a second strap having a width of at least three inches and including a first end portion and a second end portion, said second strap being separate from and spaced from said first strap;

equalizer beam means being separate from each of said pitman arms and extending between said second end portion of each of said pitman arms, said pitman arms and said equalizer beam means cooperating with said first strap and said second strap to minimizer the bending stress applied to said means for causing movement during operation of the pumping unit;

connection means being separate from said equalizer beam means but engaging said equalizer beam means for use in interconnecting each of said first end portions of said first and second straps to said pitman arms and wherein each of said first and second straps contacts said equalizer beam means; and reciprocating means connected to said second end portions of said first and second straps and adapted to move relative to the well, said reciprocating means including a polished rod and wherein all portions of said polished rod are positioned at an angle relative to said longitudinal axis of each of said pitman arms.

2. A pumping unit, as claimed in claim 1, further including:

roller means located between said equalizer beam means and said reciprocating means, at least a portion of said roller means engaging each of said first and second straps for use in providing alignment of said straps relative to the well head.

3. A pumping unit, as claimed in claim 1, wherein:

said crank arm means includes a crank arm, dogleg extending from said crank arm and having a portion that forms an oblique angle relative to said crank arm, said dogleg portion being connected to one of said pitman arms but being separate therefrom, said means for causing movement includes a weighted arm and a shaft about which said weighted arm and said crank arm rotates, said oblique angle being such that the mass center of said weighted arm is directly above in a vertical direction the center line of said shaft when said reciprocating means is at the bottom of its stroke relative to the well.

4. A pumping unit for use at a well having a well head, comprising:

support means;

a pair of pitman arms, each of said pitman arms having a first end portion and a second portion, at least one of said pitman arm including a hollow interior for receiving lubricating oil;

means including crank arm means for causing movement of said pitman arms, said means for causing movement connected to said support means and to said first end portion of each of said pitman arms;

at least a first strap having a width of at least three inches and including a first end portion and a second end portion;

equalizer beam means extending between said second end portion of each of said pitman arms and connected to each of said second end portions of said pitman arms and also connected to said first end portion of said first strap, said pitman arms and said equalizer beam means cooperating with said first strap to minimize the bending stress applied to said means for causing movement during operation of the pumping unit;

a bearing housing for receiving the lubricating oil;

a recirculation member interconnecting said hollow interior of said one pitman arm and said bearing housing to enable the lubricating oil to recirculate; and sealing means connected to said bearing housing to provide a fluid tight seal in order to prevent the escape of the lubricating oil.

* * * * *